United States Patent [19]

Greenwood

[11] 4,237,718

[45] Dec. 9, 1980

[54] BENDING TOOL

[75] Inventor: William S. Greenwood, Nutley, N.J.

[73] Assignee: Thomas & Betts Corporation, Raritan, N.J.

[21] Appl. No.: 42,536

[22] Filed: May 25, 1979

[51] Int. Cl.[3] ..... B21D 7/06

[52] U.S. Cl. ..... 72/410; 72/451; 81/376

[58] Field of Search ..... 72/410, 409, 451, 412; 29/268; 81/372, 374, 376, 381, 383

[56] References Cited

U.S. PATENT DOCUMENTS

| | | | |
|---|---|---|---|
| 2,556,725 | 6/1951 | Hurlbut | 72/409 |
| 2,696,747 | 12/1954 | Bergan | 81/376 |
| 2,743,634 | 5/1956 | Badeau | 81/376 |
| 3,170,345 | 2/1965 | Poingt | 81/374 |
| 3,492,854 | 2/1970 | Eppler | 72/412 |
| 3,514,990 | 6/1970 | Bauknight | 72/410 |
| 3,549,786 | 12/1970 | Kuo | 339/95 R |
| 3,576,122 | 4/1971 | Churla | 72/413 |
| 4,048,839 | 9/1977 | Peterpaul | 72/412 |

*Primary Examiner*—Francis S. Husar

*Assistant Examiner*—Gene P. Crosby

*Attorney, Agent, or Firm*—James J. Daley; Robert M. Rodrick; Jesse Woldman

[57] ABSTRACT

A bending tool for bending a bendable member. The bending tool includes first and second engaging members each having an engaging surface for engaging a portion of the bendable member. A first support member supports the first engaging member and a second support member is provided for supporting the second engaging member. Mounting means mount the second support member for relative movement with respect to the first support member between an open position in which the first and second engaging members are spaced from one another a first distance, and a closed position in which the first and second engaging members are spaced from one another a second distance less than the first distance. Pivotal mounting means are provided for pivotally mounting the second engaging member on the second support member so as to be pivotable with respect to the second support member independent of relative movement of the first and second support members.

21 Claims, 5 Drawing Figures

BENDING TOOL

BACKGROUND OF THE INVENTION

The present invention relates to a bending tool, and more particularly to a bending tool which is particularly useful for bending of a bendable member along a bending line which divides the bendable member into first and second arm portions.

The bendable members for which the present invention is particularly useful may for example comprise electrical connectors used for providing electrical connection with suitable conductors. Examples of such bendable members are disclosed in U.S. Pat. No. 3,549,786 and in U.S. Application Ser. Nos. 42,356 and 42,441, filed on even date herewith and entitled "Termination Connector" and "Self-Locking Clamp Member," respectively. However, it will be apparent to those skilled in the art that the bending tool of the present invention is also useful with other types of bendable members for other applications.

Typical electrical connectors for which the bending tool of the present invention is particularly useful have generally been of a folded or hinged construction so as to permit their placement over the end or edge of an insulated conductor or conductors of a flat conductor cable. The hinged construction identifies the point about which the closure will take place so that when the connector is installed in place, the first and second arm portions are adapted to overlie one another with the conductor being located therebetween. Such hinged connectors may for example include a plurality of pointed protrusions or teeth, or other devices located on the internal facing sides of the connectors for providing a piercing and/or material displacing action of the insulating material covering and separating the individual conductors in the flat conductor cable (see for example the aforementioned U.S. Pat. No. 3,549,786 and application Ser. Nos. 42,356 and 42,441). This piercing and/or material displacing action typically affords a means of establishing electrical contact between the connector and the conductor. In more recent type electrical connectors, means for locking or affixing the installed connector in its closed configuration may also be provided so that the natural resilient properties of the materials held in compression by the installed connector do not degrade the electrical connection by separating the closed halves of the connector (see for example the aforementioned copending U.S. application Ser. No. 42,441, entitled "Self-Locking Clamp Member"). Still further, provision may be made for securing or terminating the connector to a receiving point, thereby providing means for the transfer of electrical power from the cable to a suitable receptacle (see for example the aforementioned copending U.S. application Ser. No. 42,356, entitled "Termination Connector").

Prior to installation, such electrical connectors have their respective arm portions separated or inclined with respect to one another to allow for the flat conductor cable therebetween. The connectors are then crimped, folded or otherwise bent to install or clamp the connectors in place on the flat conductor cable. Preferably, in the installed condition, the two arm portions will lie both flat and parallel to each other and to the conductor therebetween . This ensures the desired action of any insulation piercing and/or material displacing devices to properly establish electrical contact between the connector and the conductor. Additionally, such an arrangement will minimize forces tending to unbend the connector so as to ensure that the connector will remain installed in place.

As can be appreciated, it is most important for the proper installation of such hinged type connectors that the force used to achieve closure be applied in a manner such that the desired configuration for the connector when installed is achieved. In this regard, it is preferable that a uniform pressure distribution be applied to both sides or arm portions of the connector, (and ideally over the entire flat outside surfaces of the two arm portions) during the closure operation.

Prior art bending tools for bending of such hinged type connectors have generally utilized a toggle mechanism in order to provide high force multiplying characteristics in a compact size so that the tool is comfortably usable with one hand while at the same time providing the high measure of force required for completing a proper closure of hinged type connectors. Two examples of the most commonly used hand tool configurations employing such toggle mechanisms are shown schematically in FIGS. 1 and 2. In both of these FIGS., the open position of the tool (i.e., the position for receiving the hinged type connector before installation) is shown in solid outline while the closed position of the tool (i.e., the position after bending of the connector) is shown in dotted outline.

The tool represented by FIG. 1 is a linear motion type tool 10 having a movable jaw or die member 12 fixably secured to a movable support member 14 which in turn is guided by a guide 16 to move along a straight line path perpendicularly toward a stationary jaw or die member 18 supported by the main tool body 20. A link 22 is pivotally connected at 24 to the end of the movable support member 14 and pivotally connected at 26 to a moving member or handle 28. The handle 28 is pivotally connected at 30 to the tool body 20 so that pivotal movement of the handle 28 about the pivot connection 30 causes the movable support member 14 and jaw 12 fixably supported thereon to move towards the stationary jaw 18 to effect a closing of a connector inserted between the two jaws 12, 18. The toggle mechanism, which comprises link 22 and the end of the handle 28 develops its greatest force only when the included angle between the link 22 and handle 28 approaches 180° (i.e., when the two portions form a staight line).

With such a tool 10, the jaws 12, 18 first contact the connector at its widest point, and unless some provision is made to restrain the connector in the jaw members 12, 18, the connector would have a tendency to "float" between the two jaw members 12, 18 whereby neither arm portion of the connector is fully contacted by the jaws 12, 18. Thus, the force applied by the two jaw members 12, 18 would be concentrated at the ends of the two arm portions of the connector, thereby possibly resulting in a non-uniform closing of the connector about its bending line with the sides or arm portions of the connector being distorted or bowed. Such an improper closure may result in a non-uniform displacement and/or penetration of the conductor insulating material and the possibility of inadequate electrical contact.

In the other type of tool configuration, represented in FIG. 2, a toggle linkage mechanism is again provided which comprises a first link 22' pivotally connected at 24' to a pivotally mounted support arm 14' and at 26' to the end of a handle 28', which handle 28' in turn is pivotally supported at 30' on the tool body 20'. A jaw member 12' for engaging one arm portion of a connector is fixably secured to the end of the pivotal support member 14' so that the jaw member 12' pivots or swings about the fixed pivot point 32 of the support arm 14' in moving between the open position and the closed position. That is, the jaw member 12' is moved towards the stationary jaw or die member 18' on an arc about the fixed pivot point 32 of the support arm 14'.

while this latter configuration provides a more suitable mechanism for proper installation of hinged type connectors, it requires that the fixed pivot point 32 be precisely located in line with the hinged fold. Additionally, it requires that the connector always be properly placed accurately between the jaw or die members 12', 18' so that the hinged fold will always be in line with the fixed pivot point. If this is not achieved, the closure would again start with pressure being exerted only at the widest points of the connector, thus resulting in similar problems as experienced with the tool represented in FIG. 1.

The present invention is directed to an improved bending tool for overcoming these and other disadvantages experienced in the prior art.

SUMMARY OF THE INVENTION

In accordance with the present invention, there is provided an improved bending tool for bending a bendable member. The bending tool comprises first and second engaging members each having an engaging surface for engaging a portion of the bendable member. A first support member is provided for supporting the first engaging member, and a second support member is provided for supporting the second engaging member. The bending tool includes mounting means for mounting the second support member for relative movement with respect to the first support member between an open position in which the first and second engaging members are spaced from one another a first distance, and a closed position in which the first and second engaging members are spaced from one another a second distance less than the first distance. The bending tool further includes pivotal mounting means for pivotally mounting the second engaging member on the second support member so as to be pivotable with respect to the second support member independent of relative movement of the first and second support members. Accordingly, the second engaging member is not rigidly fixed to the second support member, but instead is free to swivel or pivot about its pivotal connection to such member. In this way, it is possible to ensure that the bending forces for bending the bendable member are applied uniformly or at least at the desired places on the bending member for ensuring proper and correct bending.

In one aspect of the preferred embodiment, the second support member is pivotally connected to the first support member to move between the open and the closed position. However, with such an arrangement in accordance with the present invention, (and unlike the prior art shown in FIG. 2) proper bending or closing of the bendable member is not dependent upon the pivotal connection of the second support member being in line with the hinge point or bending line of the bendable member, nor is proper closure or bending dependent on proper placement of the bendable member between the two engaging members.

In another aspect of the preferred embodiment, the bending tool includes moving means for moving the second support member with respect to the first support member between the open and closed positions, and still more preferably, the moving means comprises a toggle mechanism similar to that employed with respect to bending tools for electrical connectors shown in FIGS. 1 and 2. Still further, preferably the pivotal connection of the toggle mechanism to the second or movable support member is coaxial with the pivotal mounting means for pivotally mounting the second engaging member on the second support member.

In a still further aspect in accordance with the preferred embodiment, the pivotal mounting means for the second engaging member pivotally mounts the second engaging member for pivotal movement between a first pivot position and a second pivot position. Preferably, the second support member includes first and second stop means for stopping the pivotal movement of the second engaging member relative to the second support at the first and second pivot positions. In the preferred embodiment, the first and second stop means comprise first and second stop surfaces on the second support member for engaging a portion of the second engaging member to stop the second engaging member at the first and second pivot positions, respectively.

These and further features and characteristics of the present invention will be apparent from the following detailed description in which reference is made to the enclosed drawings which illustrate the preferred embodiment of the present invention.

DETAILED DESCRIPTION OF THE PREFERRED EMBODIMENT

Figure 3:
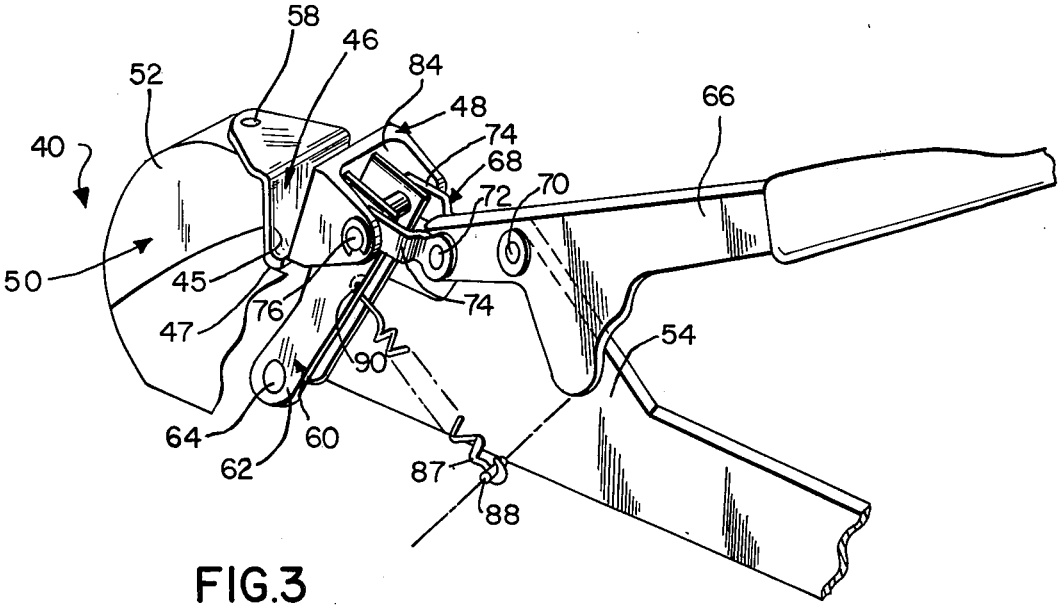
FIG. 3 is a fragmentary perspective view of a bending tool in accordance with the present invention showing the support members for the engaging members in the open position.
Figure 4:
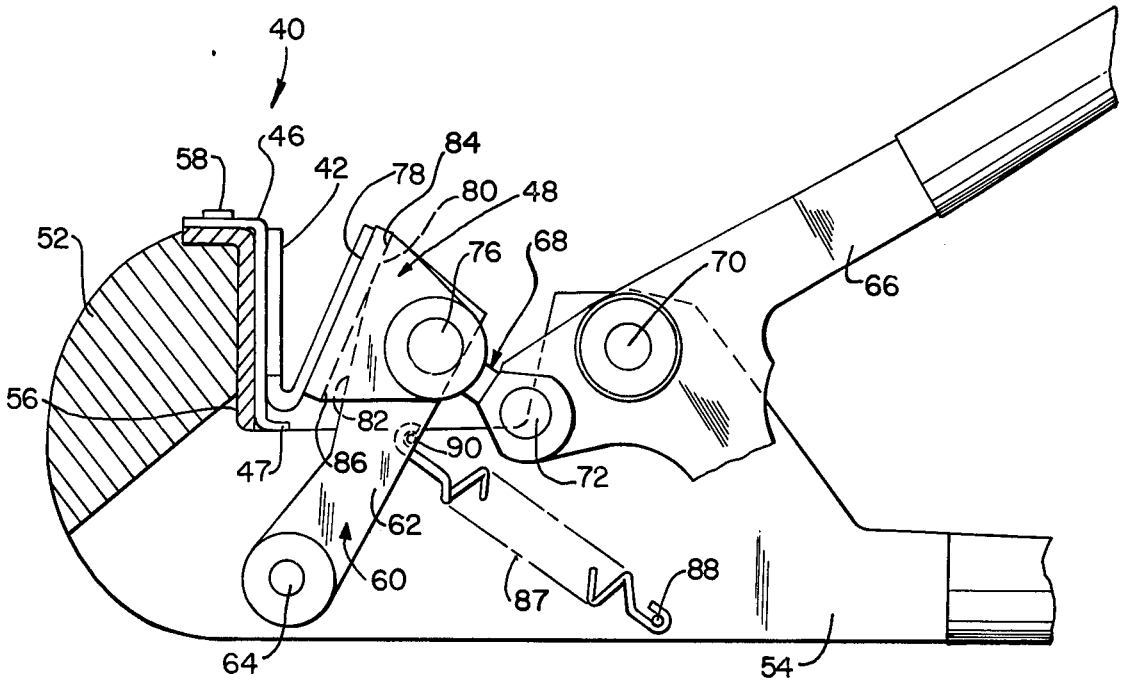
FIG. 4 is a fragmentary side elevational view, partly in section, of the bending tool of FIG. 3 showing the support members in the open position and with a bendable member positioned between the two engaging members.
Figure 5:
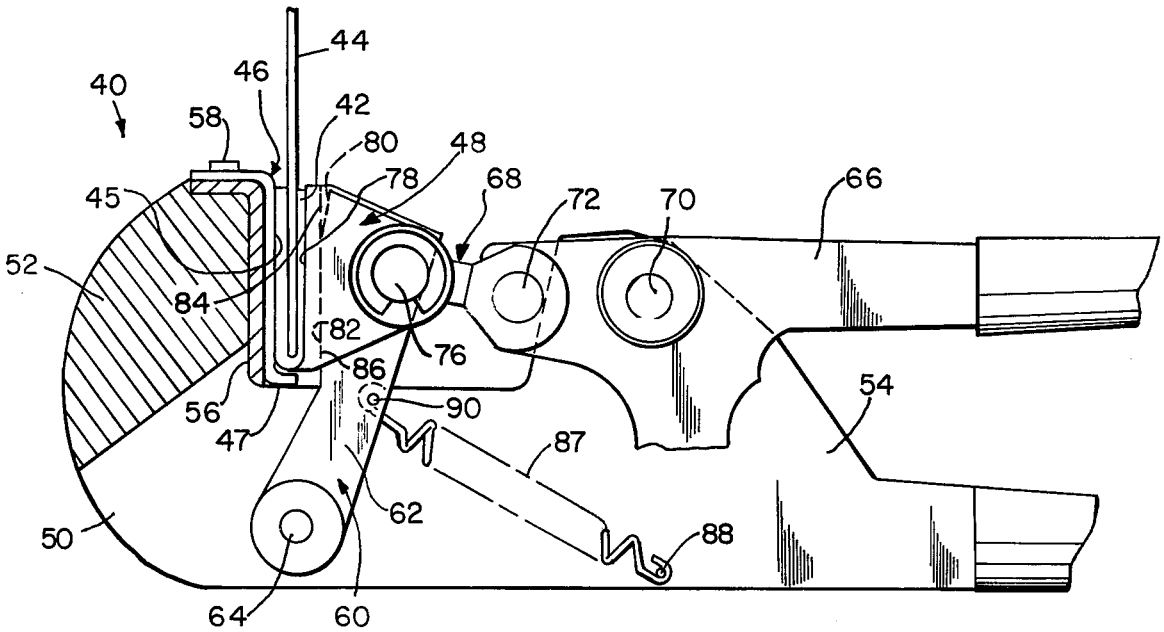
FIG. 5 is a fragmentary side elevational view similar to that shown in FIG. 4 but illustrating the supporting members in the closed position.

Referring now to the drawings in which like reference characters represent like elements, there is shown in FIGS. 3–5 a bending tool 40 in accordance with the present invention which is particularly useful for bending and closing an electrical connector 42 for a flat conductor cable 44. For example, such connectors may be of the type disclosed in the aforementioned copending U.S. application Ser. Nos. 42,356 and 42,441 entitled "Termination Connector" and "Self-Locking Clamp Member." However, it should be realized that although the present invention will be described with reference to use of the bending tool 40 of the present invention for bending such electrical connectors 42 for flat conductor cable 44, the present invention is not limited to such use and may in fact be used for a wide variety of different types of bendable members in which it is desired to effect a bending thereof.

As best shown in FIG. 3, the bending tool 40 of the present invention comprises a pair of engaging or die members 46, 48 which are adapted to engage a bendable member, such as for example, an electrical connector 42, to bend same along a bending line. The first engaging member 46 is fixably supported on a first support member 50, which in the embodiment shown comprises a tool frame member comprising a solid head portion 52 and a pair of spaced arms 54 which are integral therewith. The pair of spaced arms 54 serve as one handle of the bending tool 40. The first engaging member 46 comprises a die plate 46 having an engaging surface 45 and a lip 47 for supporting the connector 42 along the hinged portion. The die plate 46 and a back-up plate 56 (see FIGS. 4 and 5) are screwed with screw 58 to the head portion 52 of the tool frame member 50 which is provided with a suitable recess therefor.

A second support member 60 which comprises a pair of support links 62 are provided for supporting the second engaging member 48 for movement relative to the tool frame member 50. The support links 62 are each pivotally connected between the pair of spaced arms 54 of the tool frame member 50 by means of a pin 64 which also extends between the pair of spaced arms 54 and is fixably connected thereto. A movable handle member 66 and pair of toggle links 68 are provided for moving the pair of support links 62 between an open position (shown in FIG. 4) and a closed position (shown in FIG. 5) to move the second engaging member 48 toward and away from the fixedly supported die plate 46. More particularly, the movable handle 66 comprises an elongated member which is pivotally connected between the pair of spaced arms 54 of the tool frame member 50 by pin 70. The toggle link members 68 are each pivotally connected by means of a pin 72 on opposite sides of the end of the handle 66, and include, at the opposite end, an offset portion 74. The offset portions of the pair of toggle links 68 are in turn connected on opposite sides of the pair of support links 62 by means of a pin 76 which extends therethrough (see FIG. 3).

Figure 2:
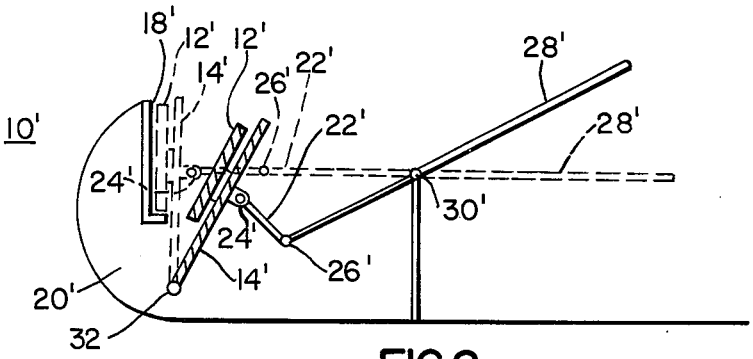
FIG.2 (PRIOR ART)
FIG. 2 is a schematic representation of a prior art bending tool, also utilizing a toggle mechanism in which the movable support member is pivotally supported on the tool body for rotary movement between open and closed positions.

In this way, pivotal movement of the handle 66 in a clockwise direction (as viewed in FIG. 4) about its pivot pin 70 will cause the support links 62 to move towards the fixed die plate 46, and pivotal movement of the handle 66 in the counterclockwise direction (as viewed in FIG. 4) will cause the support links 62 to pivot or swing away from the die plate 46. In this regard, it should be noted that this arrangement of support links 62, handle 66 and toggle links 68 is essentially equivalent to the prior art arrangement schematically shown in FIG. 2.

In accordance with the present invention, the second engaging member 48 is pivotally supported on the pair of support links 62 for pivotal movement relative to the support links and independent of movement of the support links 62 toward and away from the fixed die plate 46. Preferably, the second engaging member 48 comprises a generally U-shaped die member having an engaging surface 78 (see FIGS. 4 and 5) and being pivotally supported on the pin 76 pivotally connecting the support links 62 and toggle links 68 together.

Because of this pivotal connection of the U-shaped die member 48 with the support links 62, the engaging surface 78 of the U-shaped die member can be oriented to contact the surface of the connector 42 inserted between the two die members 46, 48 uniformly or flat, and not simply at the widest point of the two arms of the conductor 42. That is, when the tool 40 in accordance with the present invention is in its open position, and a connector 42 inserted between the two die members 46, 48, as the movable handle 66 is pivoted clockwise to pivot the support links 62 in a counterclockwise direction, the engaging surfaces 45, 78 (i.e., the substantially flat planar surfaces of the die members) will engage substantially the entire outer surfaces of the connector arms and not simply one point or small portions of the arms. Because the connector 42 to be bent will be contacted uniformly along its outer surfaces, the closure forces for closing the connector 42 will be applied uniformly so that the two arms of the connector 42 will lie substantially flat and parallel to one another when the connector 42 is closed and installed onto a flat conductor cable 44 (see FIG. 5)

It will further be noted that during the movement of the support links 62 from the open position towards the closed position, the movable die member 48 will pivot about its pivot pin 76 so that the engaging surface 78 will substantially contact the surface of the arm of the connector 42 during the entire movement. Also, it should be appreciated that the other arm of the connector 42 will lie substantially flat against the engaging surface 45 of the stationary die member 46 during this entire operation also.

Preferably, the movable die member 48 is supported for pivotal movement between first and second pivot positions--the first pivot position corresponding to the predetermined open angle of the connector 42 when the connector 42 is initially inserted into the tool 40 and the support links 62 moved to contact the engaging member 48 initially with the connector 42 (i.e., the open position of the tool 40), and the second pivot position corresponding to the die member 48 being arranged to be substantially parallel to the stationary die member 46 when the tool 40 is in the closed position. In between these two pivot positions, the die member 48 is free to pivot and assume any desired position so that substantially the entire arm of the connector will be engaged by the engaging surface 78 of the die member 48.

In the preferred embodiment, the means for stopping the movable die member 48 at the first and second pivot positions comprises first and second stop surfaces 80, 82 at the forward edge and intermediate portion of the support links 62. The first stop surface 80 is shaped in a manner as to locate and stop the die member 48 so that its engaging surface 78 is at substantially the predetermined opening for the angle of the connector 42 when the tool 40 is in the open position. The second stop surface 82 is shaped so that it stops and locates the engaging surface 78 of the die member 48 in a position substantially parallel to the engaging surface 45 of the stationary die plate 46 when the tool 40 is in the closed position.

As best seen in FIGS. 4 and 5, the first and second stop surfaces 80, 82 are inclined with one another so that as the support links 62 pivot about their fixed pivot point 64 in moving from the open to the closed position, the movable die member 48 will pivot about its pivot point (pin 76) from the front surface 84 of the die member 48 being engaged by the first stop surface 80 to the rear surface 86 being engaged by the second stop surface 82. This orientation of the two stop surfaces 80, 82 thus provides a convenient means for initially locating the die member 48 with respect to the connector 42 prior to the closing operation, and for ensuring that the engaging surfaces 45, 78 of the two die members will be substantially parallel to one another after the tool 40 has been moved to the closed position.

In this regard, it is to be noted that the first stop surface 80 preferably contacts the front surface 84 of the die member 48 in a manner so that the engaging surface 78 substantially corresponds to the predetermined open angle of the connector 42 to substantially engage the entire arm of the connector 42 and not to engage just a small portion thereof. Of course, the first pivot position of the die member 48 for locating the engaging surface 78 with respect to the connector 42 can be adjusted by adjusting the orientation of the stop surface 80 of the support links 62 accordingly. Preferably, this stop surface 80 on the support links 62 will correspond to the maximum predetermined open angle expected for the connector 42 so that if the connector arms are bent at a slightly less angle, the die member 48 will be able to pivot into place to engage substantially the entire surface of one arm, or to engage at least a substantial area to provide a substantially uniform pressure thereon during the closing operation.

Preferably, the pair of support links 62 are spring biased toward the open position. In the preferred embodiment, this is accomplished with the use of a coil spring 87 which is connected at one end to the pair of support links 62, such as by pin 90, and at the other end to the tool frame member 50 by means of pin 88. In this way, as soon as the bending operation has been completed, and the handle 66 is released, the pair of support links 62 will be pivoted towards the open position to allow the connector 42 to be removed from between the die members 46, 48.

In order to operate the tool 40 to provide for a bending or closing operation, such as for example on an electrical connector 42 to be installed on a flat conductor cable 44, the connector 42 is initially located between the die members 46, 48 when the support links 62 are in the open position relative to the main frame member 50 as shown in FIG. 4. It will be noted that when the connector is so positioned between the die members 46, 48, one of the arms of the connector 42 lies substantially flat against the first die member 46 and the other arm is engaged in a substantially flat manner by the engaging surface 78 of the second die member 48.

After the connector 42 has been placed between the two die members 46, 48 and flat conductor cable 44 inserted between the interior surfaces of the connector 42, the movable handle 66 is rotated or pivoted clockwise about its pivot pin 70 to in turn pivot the support links 62 towards the stationary die member 46 to effect a closing operation of the two arms of the connector. During this operation, the movable die member 48 will pivot about its pivot pin 76 so as to remain in substantial contact with the surface of the arm it engages to effect a substantially uniform pressure on the arm to close same to install the connector 42 on the flat conductor cable 44 (see FIG. 5). It will be noted that this closing operation is not dependent on precise placement of the connector 42 between the two die members 46, 48 as the provision for pivotal movement of the die member 48 relative to the support links 62 will cause the engaging surfaces 78 to follow the orientation of the arm during closure. Further, it is to be noted that the pivot pin 64 for the support links 62 does not have to lie in a precise location with respect to the bending line or hinge location of the connector 42.

Figure 1:
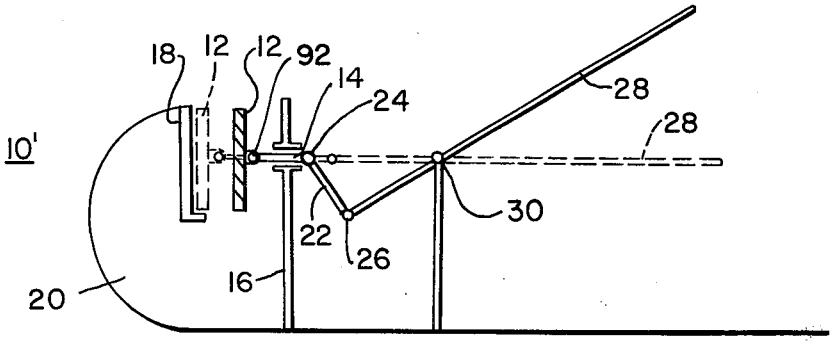
FIG.1 (PRIOR ART)
FIG. 1 is a schematic representation of a prior art bending tool utilizing a toggle mechanism for moving of a jaw supporting member along a linear path, between open and closed positions of the tool.

It should be realized that the pivotal mounting of the second die member 48 on the support links 62 for effecting movement of the movable die member 48 towards and away from the stationary die member 46, as shown in the preferred embodiment, could also be used in connection with a tool in which the support member is moved in linear motion instead of pivotal motion, such as for example that type of tool 10 shown schematically in FIG. 1. In other words, the engaging member 12 mounted on the end of the support member 14 slidable in the guide 16 shown in FIG. 1 could be pivotally mounted in accordance with the present invention, instead of stationarily mounted as shown in the prior art. The pivotal mounting would be at the location 92 in FIG. 1. Again, such an arrangement would provide many of the same advantages realized with respect to the preferred embodiment in which the support member 62 is mounted for pivotal or swingable movement relative to the main frame member 50. In the linear motion type arrangement, the sliding support member 14 could be provided with an end surface having first and second stop surfaces for engaging a portion of the pivotally mounted engaging member as shown in FIGS. 3-5 properly orient the engaging surface of the movable die member relative to substantially and uniformly contact one of the arms of a bendable member inserted between the two die members.

Further, it should be noted that use of the present invention is not limited to employment with a toggle mechanism for effecting movement of one support member relative to the other support member. Rather, the pivotal mounting of the movable engaging or die member for providing pivotal movement independent of movement of its support member relative to another support member could be employed with other arrangements of bending tools.

Thus, it is seen that in accordance with the present invention, there is provided an improved bending tool 40 in which one of the engaging members 48 for engaging a bendable member 42 to bend same along a bending line is pivotally mounted for pivotal movement relative to the member 62 it is supported on, independent of movement of such support member 62. With such an arrangement, it is thus possible to uniformly apply a load on the bendable member 42 to provide a uniform bending thereof, especially with respect to hinged type electrical connectors 42 which are designed to be bent to a position in which the two arm portions lie flat and parallel to one another.

To summarize the foregoing, a hand bending tool 40 has a tool frame or first support member 50 having at a first end a pair of spaced arms 54 which form a fixed handle which can be fitted with a handle grip, if desired, and at a second end a solid head portion or fixed jaw 52. Pivotally coupled thereto as by pivot 70 is a movable handle means 66 terminating in a movable handle at a first end which may also be fitted with a handle grip. The pivotal coupling 70 between the tool frame 50 and the movable handle means 66 permits the movable handle to be moved towards and away from the fixed handle. A mounting means or pin 76 is coupled by links 68 to the second end of the movable handle means 66 so that the mounting means or pin 76 is moved towards the fixed jaw 52 as movable handle 66 is moved towards the fixed handle 54. A die means or member 48 is pivotally coupled to the mounting means 76 independent of the relative movement of the fixed jaw 52 and the mounting means 76.

A fixed die member 46 can be fitted to the fixed jaw 52 and link means 62 can be pivotally coupled between mounting means 76 and first support member or tool frame 50 by means of pin 64. Stop means 80 placed upon the links 62 limit the pivotal movement of the movable die means 48 about the pivotal coupling means 76 in a first direction. A stop means 82 placed upon the links 62 limit the pivotal movement of the movable die means 48 about the pivotal coupling means 76 in a second direction.

While the preferred embodiment of the present invention has been shown and described, it will be understood that such are merely illustrative and that changes may be made without departing from the scope of the invention as claimed.

What is claimed:

1. A bending tool for bending a bendable member, said bending tool comprising:

first and second engaging members each having an engaging surface for engaging a portion of a bendable member;

a first support member supporting said first engaging member;

a second support member for supporting said second engaging member;

mounting means for mounting said second support member for relative movement with respect to said first support member between an open position in which said first and second engaging members are spaced from one another a first distance and a closed position in which said first and second engaging members are spaced from one another a second distance less than said first distance; and pivotal mounting means for pivotally mounting said second engaging member on said second support member to be pivotable with respect to said second support member independent of relative movement of said first and second support members.

2. The bending tool of claim 1 wherein said first engaging member is fixably supported on said first support member.

3. The bending tool of claim 1 wherein said engaging surfaces of said first and second engaging members are adapted to be parallel with one another when said first and second support members are in said closed position.

4. The bending tool of claim 1 further including moving means for moving said second support member with respect to said first support member between said open position and said closed position.

5. The bending tool of claim 4 wherein said moving means comprises a link member pivotally connected at one end to said second support member and at its other end to a moving member, and wherein said moving member is pivotally connected to said first support member at a location spaced from said pivotal connection of said moving member and said link member.

6. The bending tool of claim 5 wherein the distance between said pivotal connection of said link member with said second support member and said pivotal connection of said moving member with said first support member when said second support member is in said open position is less then the distance between said pivotal connection of said link member with said second support member and said pivotal connection of said moving member with said first support member when said second support member is in said closed position.

7. The bending tool of claim 5 wherein said pivotal connection of said one end of said link member to said second support member is coaxial with said pivotal mounting means for pivotally mounting said second engaging member on said second support member.

8. The bending tool of claim 1 wherein said mounting means comprises means for pivotally mounting said second support member on said first support member to be pivotable between said open position and said closed position.

9. The bending tool of claim 8 wherein said pivotal mounting means for said second engaging member is spaced from said means for pivotally mounting said second support member on said first support member.

10. The bending tool of claim 9 further including bias means for biasing said second support member towards said open position.

11. The bending tool of claim 10 wherein said bias means comprises a spring connected at one end to said second support member and at the other end to said first support member.

12. The bending tool of claim 1 wherein said pivotal mounting means for said second engaging member pivotally mounts said second engaging member for pivotal movement between a first pivot position and a second pivot position.

13. The bending tool of claim 12 wherein said second support member includes first and second stop means for stopping pivotal movement of said second engaging member relative to said second support member at said first and second pivot positions.

14. The bending tool of claim 13 wherein said first and second stop means of said second support member comprise first and second stop surfaces for engaging a portion of said second engaging member to stop said second engaging member at said first and second pivot positions respectively.

15. The bending tool of claim 14 wherein said first and second stop surfaces of said second support member are inclined with respect to one another.

16. A hand tool for crimping a deformable electrical connector to an electrical conductor comprising:

an elongated tool frame having a fixed handle at one end and a fixed jaw at the other end;

movable handle means having a movable handle at a first end and having a second end, said movable handle means being pivotally coupled to said tool frame for relative movement of said movable handle towards and away from said fixed handle;

support means;

first means for coupling said support means to said second end of said movable handle means to move said support means towards said fixed jaw as said movable handle is moved towards said fixed handle;

die means; and pivotal coupling means for pivotally coupling said die means to said support means to be pivotable with respect to said support means independent of the relative movement of said fixed jaw and said support means.

17. A hand tool as defined in claim 16, wherein a fixed die member is fixedly supported on said fixed jaw.

18. A hand tool as defined in claim 16, said support means comprising link means coupled at a first end to said first means and at a second end to said tool frame.

19. A hand tool as defined in claim 16, said support means comprising link means coupled at a first end to said first means and at a second end to said tool frame and resilient means coupled to said link means and said tool frame to initially position said first means.

20. A hand tool as defined in claim 16, said support means comprising link means coupled at a first end to said first means and at a second end to said tool frame; and stop means on said link means engageable with said die means to limit the pivotal movement of said die means about said pivotal coupling means in a first direction.

21. A hand tool as defined in claim 16, said support means comprising link means coupled at a first end to said first means and at a second end to said tool frame; stop means on said link means engageable with said die means to limit the pivotal movement of said die means about said pivotal coupling means in a first direction; and further stop means on said link means engageable with said die means to limit the pivotal movement of said die means about said pivotal coupling means in a second direction opposite from said first direction.

* * * * *